United States Patent [19]

Perrier et al.

[11] 4,099,510

[45] Jul. 11, 1978

[54] IGNITION COIL FOR INTERNAL COMBUSTION ENGINE

[75] Inventors: Pierre Perrier, Ramonville-Saint Agne; Maurice L. Razet, Issy-les-Moulineaux, both of France

[73] Assignee: Societe Anonyme pour l'Equipement Electrique des Vehicules S.E.V. Marchal, Issy-les-Moulineaux, France

[21] Appl. No.: 712,964

[22] Filed: Aug. 9, 1976

[30] Foreign Application Priority Data

Aug. 14, 1975 [FR] France ..... 75 25324

[51] Int. Cl.[2] ..... F02P 3/02; H01F 27/30

[52] U.S. Cl. ..... 123/148 D; 336/96; 336/107; 336/178; 336/212; 336/221

[58] Field of Search ..... 336/96, 105, 107, 178, 336/212, 219, 184, 192, 220, 221; 123/148 D

[56] References Cited

U.S. PATENT DOCUMENTS

| | | | |
|---|---|---|---|
| 1,505,085 | 8/1924 | Brighom | 336/178 |
| 1,623,426 | 4/1927 | Mallory | 336/178 X |
| 1,629,132 | 5/1927 | Thordarson | 336/96 X |
| 1,779,269 | 10/1930 | Clough | 336/184 X |
| 1,880,412 | 10/1932 | Burton | 336/184 X |
| 2,068,522 | 1/1937 | Thordarson | 336/178 X |
| 2,904,763 | 9/1959 | Harruff | 336/184 X |
| 2,990,497 | 6/1961 | Rugg | 336/96 X |
| 3,155,932 | 11/1964 | Oberli | 336/184 X |
| 3,448,423 | 6/1969 | Minks | 336/96 |

FOREIGN PATENT DOCUMENTS

| | | | |
|---|---|---|---|
| 321,042 | 5/1902 | France | 336/178 |
| 840,020 | 4/1939 | France | 336/96 |
| 720,230 | 2/1932 | France | 336/184 |
| 1,538,005 | 10/1969 | Fed. Rep. of Germany | 336/184 |
| 6,410,120 | 11/1964 | Netherlands | 336/178 |

*Primary Examiner*—Thomas J. Kozma
*Attorney, Agent, or Firm*—Brisebois & Kruger

[57] ABSTRACT

An ignition coil for an internal combustion engine comprises a magnetic core having a plurality of arms lying at an angle to each other, a primary inductive winding on one of said arms and a secondary high voltage winding on another of said arms.

The primary and secondary windings are on adjacent arms and have intersecting axes, with a plane through one end of one of said windings perpendicular to the axis of said one winding intersecting both ends of the other winding.

11 Claims, 5 Drawing Figures

IGNITION COIL FOR INTERNAL COMBUSTION ENGINE

It is known that in order to produce the high voltage necessary for ignition in the combustion chambers of an internal combustion, ignition coils are used which comprise a primary inductive winding and a secondary winding. A succession of flows of current and interruptions of current is produced in the primary coil and the variations in flux due to the variations in current in the primary coil create an induced current in the secondary coil, which has a large number of turns so that a high voltage current is generated therein.

The ignition coils habitually used comprise a magnetic core constituting a straight bar about which the secondary coil is wound, said secondary coil being itself surrounded by a coaxial primary coil.

In such devices, the beginning of the secondary coil is adjacent the magnetic core, which constitutes the high voltage terminal, and the end of the secondary coil is connected to one of the ends of the peripheral primary coil. This arrangement makes it possible to avoid any difficulty with respect to insulation against the high voltage current produced, but it has the disadvantage that, even though the primary coil is at the outside, it is difficult to carry away the heat generated by the Joule effect. In order to mitigate this disadvantage and produce adequate cooling of the coil, the two windings are placed in an oil bath enclosed in a casing. This type of ignition coil has two disadvantages. In the first place, it is necessary to use an oil bath for cooling. In the second place, the induction in the secondary winding is not at its optimum because the magnetic core in the center of the winding constitutes an open magnetic circuit, in which the lines of force must close from one pole to another in the ambient medium, which results in important losses and diminishes the performance of the coil, even when a magnetic screen is positioned about the windings.

It has already been suggested that ignition coils be made which have no cooling oil bath and comprise a closed magnetic ring about which the primary and secondary windings are wound. This type of construction makes it possible to obtain an improvement in the performance of the coil since the magnetic circuit for the passage of flux is practically closed allowing for the conventional magnetic gap. However, such prior art ignition coils are not entirely satisfactory when the primary and secondary windings are positioned one around the other, for the reasons already pointed out with respect to coils having an oil bath. When the magnetic path is a quadrilateral, for example, a rectangle, it has already been suggested that the primary coil be placed on one side and the secondary winding on the opposite side, which is parallel thereto. In this case there is no further inconvenience with respect to thermal behavior, but it will be appreciated that there is poor magnetic coupling between the primary and secondary windings so that the performance of the coil is not optimal.

It is the object of the present invention to describe a coil having considerably improved performances as compared with the coils of the state of the art. In accordance with the invention the primary and secondary windings are positioned at separate points on the magnetic circuit, but, in order to improve the coupling between the two windings, they are brought closer to each other by placing them on two adjacent sides of the magnetic circuit. Moreover, in accordance with the invention, the primary coil is made in the form of a winding which is relatively long in proportion to its thickness so as to improve its cooling, and the secondary winding is made in the form of a relatively flat winding of large diameter to decrease parasitic capacitances which arise between the different superposed turns of the secondary winding, these parasitic capacitances having a tendency, on the one hand, to limit the maximum value of the voltage obtained in the secondary winding and, on the other hand, to increase the time required to attain the maximum desired voltage.

It is therefore an object of the present invention to provide the new article of manufacture which consists of an ignition coil for internal combustion motors which comprises a magnetic core about which are wound, on different zones of the core, on the one hand a primary electrically supplied inductive winding and, on the other hand, a secondary winding delivering a high voltage current, characterized by the fact that the primary and secondary windings are close to each other and have transverse axes, with the plane of one of the end faces of one of the windings crossing the two end faces of the other winding.

It may advantageously be provided that the magnetic core is a magnetic ring and that said magnetic ring has a median line forming a quadrilateral or triangle in a single plane, two axes of the two windings being preferably perpendicular to each other. The median line of the magnetic ring is preferably a rectangle or a square.

The manufacture of the magnetic ring may be carried out with a minimum loss of metal. The magnetic ring consists of a stack of plates so as to impart thereto a laminated structure avoiding losses due to the frequency of the variations in the magnetic flux. In accordance with the invention it is preferred that the magnetic ring consist of a stack of plates, each layer of which is formed by two L-shaped members, the corners of the L-shaped members being superposed in each stack. The magnetic ring consequently consists of an assembly of two stacks of L-shaped members. In a preferred embodiment of the invention the two L-shaped members which are assembled to form one layer of the stack of plates constituting magnetic ring are identical. The two arms of each L-shaped member have the same width. The primary and secondary coils are wound on the two arms of the same stack of L-shaped members.

It has been found that by adopting the dimensions of the L-shaped member hereinafter indicated as preferred, one may cut said L-shaped members from a rectangular strip of sheet metal without any losses due to cutting, the L-shaped members being interfitted one into the other to constitute the entire rectangular sheet to be cut. The adoption of this arrangement is thus useful especially to limit the cost of the coil according to the invention.

In order to insure good cooling of the primary coil it has been found that it is preferable to utilize a relatively long thin coil. It is thus preferred that the thickness of the primary winding, measured perpendicular to the median line of the magnetic ring in the zone of said winding, lie between L/50 and L/8, where L is the length of the primary winding measured parallel to the median line of the magnetic ring in the zone of the primary winding. Moreover, in order to decrease the parasitic capacitance of the secondary winding, it has been found that it is preferable to utilize a relatively flat winding. When the magnetic ring used is a square or rectangle, the use of a flat secondary winding positioned on an arm of the ring adjacent the one which carries the primary winding also makes it possible to improve the magnetic coupling between the two windings by extending the flat surface occupied by the secondary winding at right angles to the zone occupied by the primary winding. Preferably, as a consequence, the thickness of the secondary winding measured perpendicularly to the median line of the magnetic ring in the zone of said winding lies between 1 and 6 l, where l is the length of the secondary winding measured parallel to the median line of the magnetic ring in the zone of the secondary winding.

It is also preferred, in order to improve the coupling of the primary and secondary windings and decrease the time required to obtain the maximum high voltage, that the median plane equi-distant from the end planes of the primary winding be transverse or at least tangent to the secondary winding.

It should be also noted that the adoption of a flat secondary winding in the form of a roll makes it possible to decrease the difference in voltage between two successive layers of the secondary winding. It follows that the difficulties in insulation which are common between the successive layers of the secondary winding disappear. In accordance with the invention the superposed layers of wires in the secondary winding are thus wound directly one upon each other without the interposition of any insulation other than that which surrounds the coiled wire. This arrangement makes it possible to use a secondary winding which comprises cheek plates at the end faces of said winding, said cheek plates being advantageously used to support the output terminal of the secondary winding.

In a preferred embodiment of the invention the magnetic ring as well as the secondary winding and its high frequency output terminal are molded from plastic material. Two stacks of L-shaped members are electrically insulated from each other. One of the stacks of L-shaped members is electrically connected to one of the terminals of the battery of the vehicle on which the coil according to the invention is mounted and constitutes a common point to which one of the ends of the primary coil and one of the ends of the secondary coil are connected, the other end of the primary coil being connected through a switch to the terminal of the battery which is not connected to the common point of the primary and secondary windings. The contact between the end of the secondary winding and the stack of L-shaped members, which serves as a common point, is provided by a pressure strip positioned between the magnetic ring and the central support for the secondary winding.

In order to facilitate the connection of the end of the primary winding to the stack of L-shaped members which electrically serves as the common point between the primary and secondary windings, it is preferred that one of the outer plates of the stack of L-shaped members of the magnetic ring be stamped to form a guide for the output wire of the primary coil which is electrically connected to said stack of L-shaped members. In order to facilitate the positioning of the primary winding on the arm of the stack of L-shaped members on which it is to be mounted, it is preferred that one of the outer plates of the stack of L-shaped members be perforated to form a seat adapted to cooperate with a positioning projection provided on the member supporting the primary winding.

It has been found that the ignition coil according to the invention has improved performance as compared with ignition coils of the same type already known in the state of the art and that, moreover, its manufacture is substantially cheaper.

German Application No. 1,538,005 describes a transformer in which the primary and secondary windings are positioned, as in the device according to the invention, on two adjacent arms of a magnetic ring having a square median line. However, important differences exist between this prior art device and the one according to the present invention. In the first place, it relates to a transformer which consequently does not have a magnetic gap in its magnetic circuit and not, as in the present invention, to an ignition coil for an automotive vehicle, the magnetic circuit of which comprises at least one magnetic gap. Moreover, the primary coil of the transformer is divided into two partial windings positioned on the two parallel arms of a magnetic ring which is not the case with the primary winding of the ignition coil according to the invention. Finally and most importantly, it is well known that one of the necessary properties of an ignition for automotive vehicles is that the secondary voltage fall as little as possible when the speed of rotation of the motor increases. However, if one compares the operation of an ignition coil according to the present invention with that of an ignition coil in which the primary and secondary windings are positioned according to the teachings of German Pat. No. 1,538,005, all the other characteristics (magnetic gap, number of turns, diameter of wire, etc.) being otherwise identical, the two following facts should be noted:

a. The secondary voltage of the coil having two primary windings falls much more rapidly than the secondary voltage delivered by the coil according to the invention during an increase in the speed of rotation of the motor associated therewith;

b. The coil having two primary windings has a secondary voltage which is, for high speeds of rotation, clearly less than that of the coil according to the invention and for this reason does not have the characteristics actually required for the ignition coil of an automotive vehicle.

In order that the object of the invention may be better understood, there will now be described, purely by way of illustration and example, one embodiment of the invention illustrated in the accompanying drawings, in which.

Figure 2:
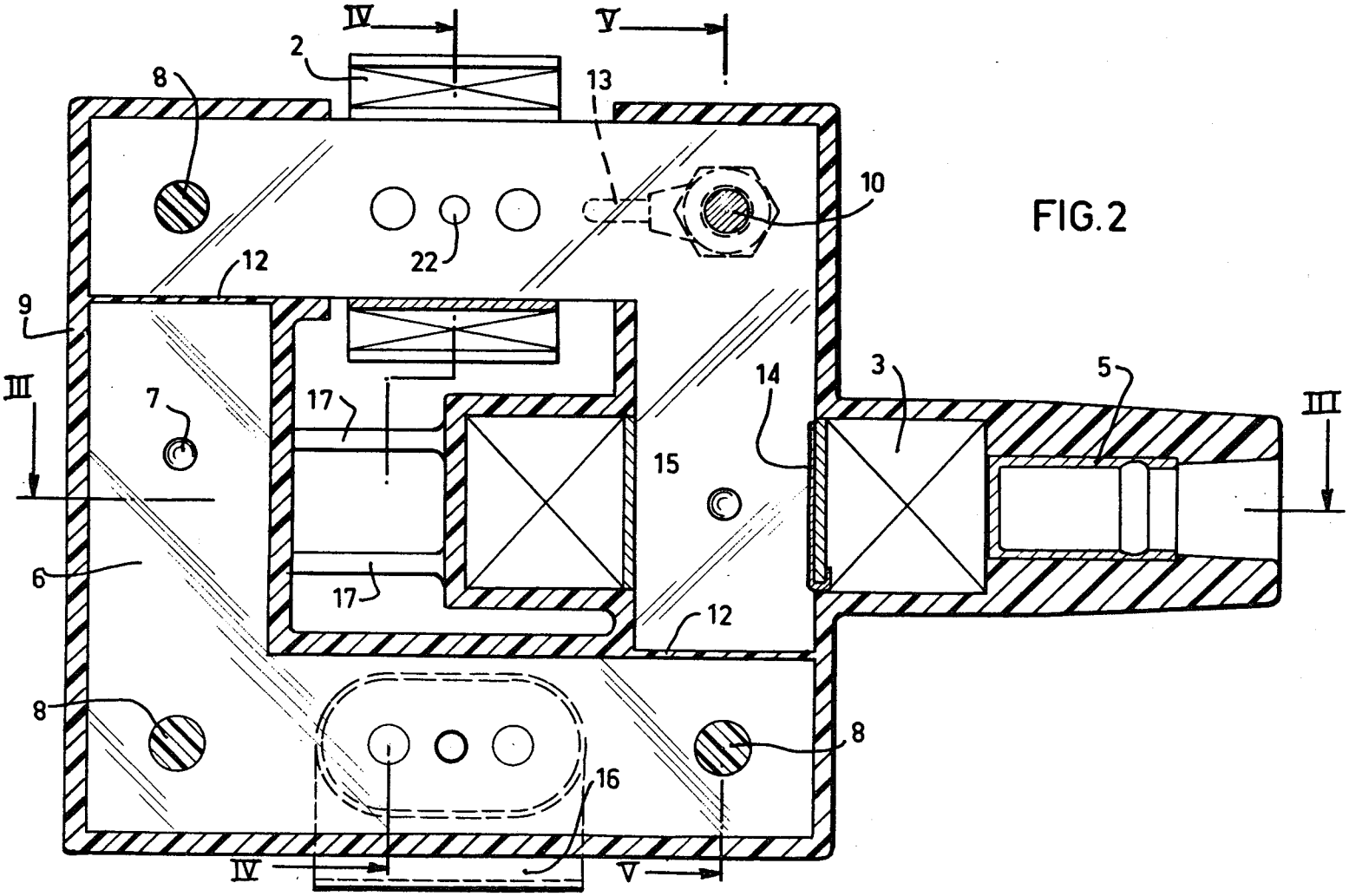
FIG. 2 shows in sectional elevation the coil of FIG. 1.
Figure 1:
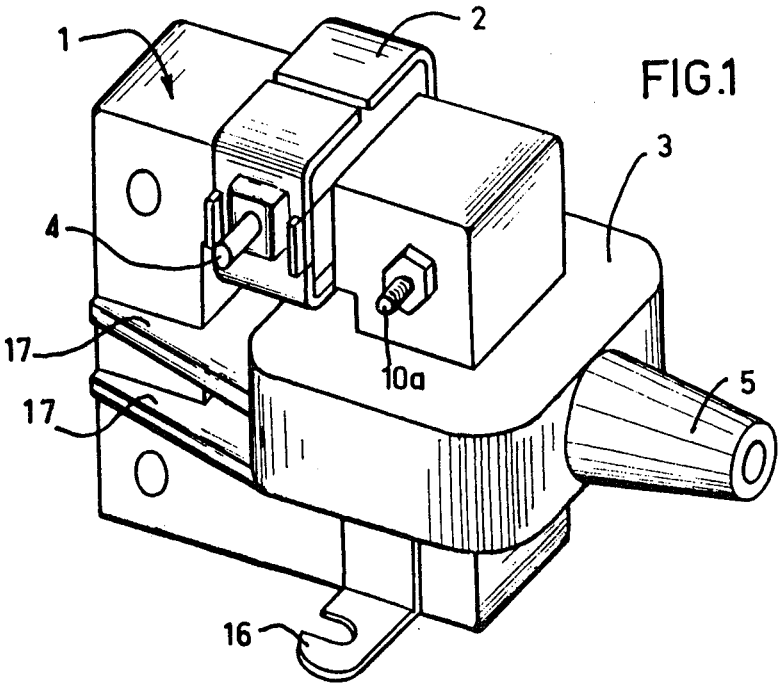
FIG. 1 is a perspective view of a coil according to the invention.
Figure 3:
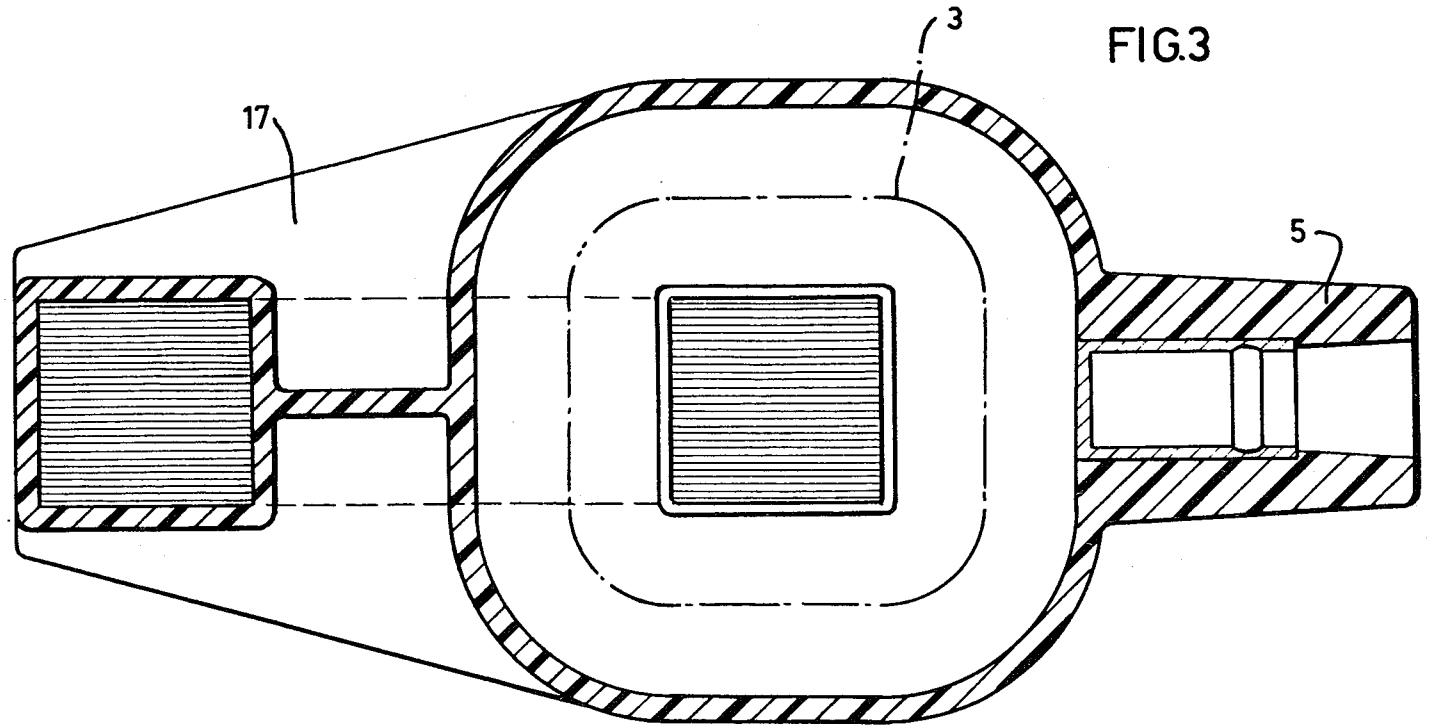
FIG. 3 is a sectional view taken along the line III—III of FIG. 2.
Figures 4, 5:
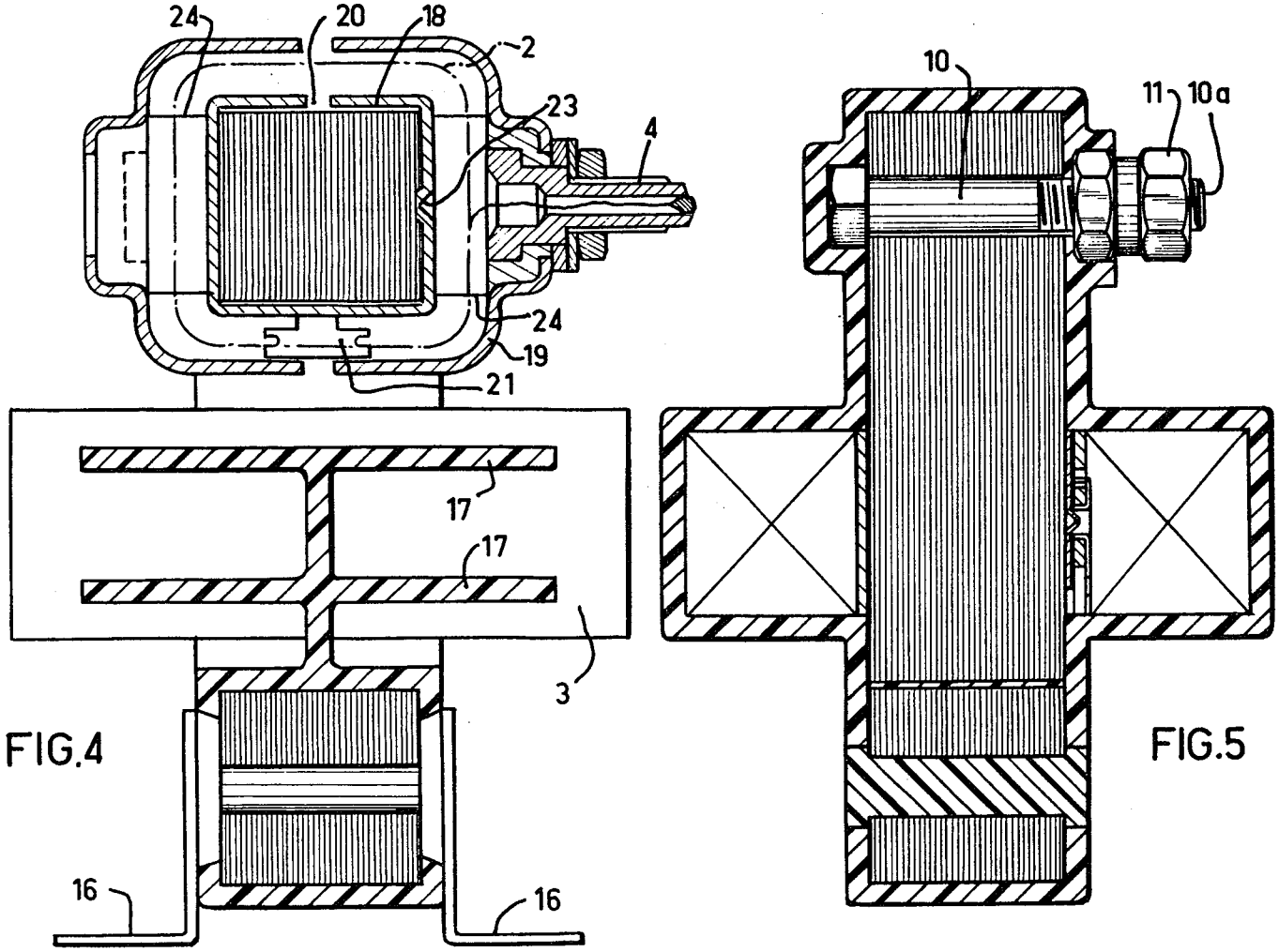
FIG. 4 is a developmental view taken along the line IV—IV of FIG. 2.
FIG. 5 is a sectional view taken along the line V—V of FIG. 2.

Referring now to the drawings, it will be seen that the coil according to the invention comprises a magnetic ring 1 around which are wound, on the one hand, a primary winding 2 and on the other hand, a secondary winding 3. The primary winding is connected by the terminal 4 to the output of a switch (not shown) which makes or breaks the connection to the ground of the vehicle with which the ignition coil in question is associated. The secondary winding 3 comprises an output terminal 5 which is electrically connected to the central contact of an ignition distributor to supply a high voltage current to the spark plugs of the combustion chamber of the motor with which the coil is associated. The magnetic ring 1 consists of a stack of magnetic sheets forming a ring having a thickness of 17.5 mm and a square median line, the width of the sides of the square being constant and equal to 17.5 mm. Each plate of the stack consists of two identical L-shaped members. Each L-shaped member comprises a short arm and a long arm. The short arm has a length measured along the inner perimeter of the L-shaped member, equal to 35 mm; the large arm has a length measured along the inner perimeter of the L-shaped member equal to 52.5 mm. The individual L-shaped members have each been designated reference numeral 6. The L-shaped members 6 comprise a stamped positioning projection 7 which makes it possible to suitably insure the positioning of the sheets of the stack of sheets. At the two ends of the long arm of each L-shaped member is a circular hole 8. All the L-shaped members are stacked to form two stacks of L-shaped members. The two stacks are assembled together by casting thereon a plastic material 9, one of the holes 8 then receiving a rivet of plastic material. The casting takes place after the primary and secondary windings have been placed in position. The hole 8 which is positioned in the corner between the primary and secondary windings is occupied by a bolt 10 which undergoes the casting operation while provided with protective means for its outer threaded zone 10*a* which is adapted to cooperate after molding with a nut 11.

The location of the two stacks of L-shaped members is such that, at the moment of casting, an insulating wall 12 is injected between these stacks, which wall electrically insulates one of the stacks of L-shaped members from the other stack.

One of the stacks of L-shaped members (the one which is positioned at the top of FIG. 2) carries on its long arm the primary winding 2 and on its short arm the secondary winding 3. It is connected by the bolt 10 and the nut 11 to the positive terminal of the battery. In the neighborhood of the bolt 10 the sheet metal of the L-shaped member comprises a stamped groove 13 which receives one of the ends of the wire of primary winding 2, which wire is electrically connected to the bolt 10 while the other end of the primary winding 2 is electrically connected to the terminal 4. One of the ends of the secondary winding 3 is connected to a pressure strip 14 which is inserted between the L-shaped member 6 and the central support 15 on which the secondary winding 3 is wound. The stack of L-shaped members which is held together by the bolt 10 thus constitutes the common point of the primary and secondary windings of the coil. The other stack of L-shaped members (the one which is positioned at the lower part of FIG. 2) is connected to the ground of the vehicle and permits the attachment of the coil to the frame by means of mounting tabs 16 which come into direct contact with the stack and are attached thereto, for example by bolts or rivets resulting from the casting.

It should be noted that the square form of the magnetic ring of the ignition coil according to the invention permits excellent conduction of the magnetic flux induced by the primary winding 2. In effect, its square form is not too far from the optimum circular form and the zones of the magnetic gap 12 which separate the two stacks of L-shaped members are extremely small. This good conduction of the magnetic flux makes it possible to improve the performance of the coil. The laminated structure of the magnetic ring makes it possible to avoid losses due to the frequency of variations in flux.

The secondary winding 3 is formed around the central support 15 by winding thereon a copper wire insulated by a varnish. No insulating paper is provided between the successive coaxial layers. The secondary winding has externally in plan the shape of a square having rounded corners and is 17 mm thick. The covering cast onto the secondary winding is connected to the opposite arm of the magnetic ring by two strips of covering 17, which make it possible to better support the weight of the secondary winding. The length of the side of the square which constitutes the secondary winding 3 is 50 mm. It should also be noted that the attachment of the coil by tabs 16 is near the winding 3 which helps avoid unnecessary projections. The end of the secondary winding wire 3 which is not electrically connected to the pressure strip 14 is connected to the outlet terminal 5 to distribute the induced high voltage current. The outer plate of the stack of plates on which the winding 3 is mounted has a stamped seat 22 which cooperates with a stamped projection 23 provided in the support 18 for the winding.

The primary winding consists of turns of aluminum in coaxial layers. The winding has a length measured parallel to the median line of the ring in the zone in which the winding lies equal to about 20 mm while its thickness measured in a direction perpendicular thereto is about 3 mm.

It has been found that the performance of such an ignition coil is particularly satisfactory, especially taking into account its low cost. One may, in effect, for a given consumption of current, obtain a maximum voltage greater by about 1500 volts than the voltage which may be obtained by means of a coil in an oil bath according to the present state of the art having an analogous bulk. Moreover, this coil fully satisfies the short circuit tests habitually required by the builders of automotive vehicles.

It will of course be appreciated that the embodiment which has been described has been given purely by way of illustration and example and may be modified as to detail without thereby departing from the basic principles of the invention.

What is claimed is:

1. An internal combustion engine ignition coil comprising a rectangular magnetic core having a median line in a single plane and consisting essentially of a stack of sheets of magnetic material, each layer of which is formed from two substantially identical L-shaped members each having two arms of the same width, so that there are two stacks of L-shaped members in which the corners of the L-shaped members are superimposed;

said rectangular core being devoid of magnetic shunt elements, said core having only one primary inductive winding and only one secondary high voltage winding thereon;

said primary inductive winding on one arm of one stack of L-shaped members, and said secondary high voltage winding on the other arm of said one stack;

said primary winding having a length L parallel to said one arm, and a thickness perpendicular to said one arm which is in the range between L/50 and L/8;

said secondary winding having a length l parallel to said other arm, and a thickness perpendicular to said other arm which is in the range of between l and 6l;

a plane through one end of one of said windings perpendicular to its arm intersecting both ends of the other winding.

2. Coil as claimed in claim 1 in which a median plane equidistant from the end planes of the primary winding is transverse with respect to the secondary winding.

3. Coil as claimed in claim 1 in which superposed layers of wires of the secondary winding are wound directly on each other without the interposition of insulation other than that which surrounds the wound wire.

4. Coil as claimed in claim 1 in which the secondary winding has side coverings supporting the output terminal of the secondary winding.

5. Coil according to claim 1 in which the magnetic core as well as the secondary winding and its output terminal are embedded in plastic material.

6. Coil as claimed in claim 1 in which the two stacks of L-shaped members are electrically insulated from each other.

7. Coil as claimed in claim 1 in which one of the stacks of L-shaped members is electrically connected to one of the terminals of a battery of a vehicle on which the coil is mounted and constitutes a common point to which one of the ends of the primary winding and one of the ends of the secondary winding are connected, the other end of the primary winding being connected through a switch to the terminal of the battery which is not connected to said common point.

8. Coil as claimed in claim 7 in which contact between the end of the secondary winding and the stack of L-shaped members which serves as a common point is through a pressure strip positioned between the magnetic ring and the central support of the secondary winding.

9. Coil as claimed in claim 7 in which one of the outer plates of the stack of L-shaped members of the magnetic ring is stamped to form a guide for the output wire of the primary winding which is electrically connected to said stack of L-shaped members.

10. Coil as claimed in claim 1 in which one of the outer plates of the stack of L-shaped members of the magnetic ring is perforated to form a seat adapted to cooperate with a positioning projection on a supporting member for the primary winding.

11. A coil according to claim 1 wherein said plane is taken through the end of the primary coil and perpendicular to its arm, and intersects both ends of the secondary coil.

* * * * *